United States Patent [19]

Carroll et al.

[11] Patent Number: 4,661,665

[45] Date of Patent: Apr. 28, 1987

[54] VACUUM INTERRUPTER AND METHOD OF MODIFYING A VACUUM INTERRUPTER

[75] Inventors: James J. Carroll, Clifton Park; Gerhard Frind, Altamont, both of N.Y.; John H. VanNoy, Pittsburgh, Pa.

[73] Assignee: General Electric Company, Schenectady, N.Y.

[21] Appl. No.: 884,326

[22] Filed: Jul. 10, 1986

[51] Int. Cl.[4] ..... H01H 33/66

[52] U.S. Cl. ..... 200/144 B; 200/147 R

[58] Field of Search ..... 200/144 B, 147 R

[56] References Cited

U.S. PATENT DOCUMENTS

| | | | |
|---|---|---|---|
| 3,283,103 | 11/1966 | Greenwood et al. | 200/147 R |
| 3,321,599 | 5/1967 | Lee | 200/144 B |
| 3,345,484 | 10/1967 | Polinko, Jr. et al. | 200/144 B |
| 3,462,572 | 8/1969 | Sofianek | 200/144 B |
| 3,852,555 | 12/1974 | Schoucker et al. | 200/144 B |
| 4,115,672 | 9/1978 | Lipperts | 200/144 B |
| 4,392,035 | 7/1983 | Frind et al. | 200/144 B |

*Primary Examiner*—Robert S. Macon

*Attorney, Agent, or Firm*—William H. Steinberg; James C. Davis, Jr.; Paul R. Webb, II

[57] ABSTRACT

A vacuum interrupter includes an evacuated envelope and a pair of facing contacts situated therein. The contacts are relatively movable along a first axis from an engaged position to a disengaged position. Conductors extending through the envelope are provided for connecting the contacts to an external circuit. A pair of magnetic field coils are disposed on opposite sides of the contacts and connected in series therewith for establishing an axial magnetic field in the space between the contacts when the contacts are in the disengaged position.

14 Claims, 4 Drawing Figures

VACUUM INTERRUPTER AND METHOD OF MODIFYING A VACUUM INTERRUPTER

The present invention relates in general to electrical circuit interruption devices and more specifically to vacuum type circuit interrupters.

BACKGROUND OF THE INVENTION

A typical vacuum type circuit interrupter comprises a pair of relatively movable contacts which can be separated, or opened, to establish a gap therebetween across which an arc is formed. This arc vaporizes some of the electrode material to create a local atmosphere through which current flows until about the time a natural current zero is reached. When this current zero is reached, the arc vanishes, and a recovery voltage transient builds up across the arcing gap. If the gap is able to withstand this recovery voltage transient the arc is prevented from reigniting and interruption is completed.

The ability of the gap to withstand the recovery voltage transient is largely dependent upon the extent to which the gap is free of ionized arcing products when the recovery voltage transient is applied. If, for example, the gap were entirely freed of arcing products, the vacuum in the interrupter would make available a very high dielectric strength to withstand the recovery voltage transient. The extent to which the gap is free of ionized arcing products when the recovery voltage transient is applied depends to a large degree on the ability of the interrupter to condense these hot arcing products prior to the application of the recovery voltage transient. The more completely the interrupter condenses the arcing products, the more likely it is that the gap will succeed in withstanding the recovery voltage transient.

During low current interruptions, the interrupter ordinarily has no difficulty in condensing the arcing products with sufficient rapidity and completeness to withstand the recovery voltage transient. However, the higher the current being interrupted, the greater the volume of arcing products which is generated, and the more difficult it becomes for the interrupter to condense these products in a time which permits interruption of the recovery voltage transient. Generally, it has been determined that when the interrupted current enters or exceeds the range of 10,000–20,000 amperes, large quantities of arcing products are generated and the ability to withstand the recovery voltage transient is diminished.

It is known in the art that by establishing an axial magnetic field in the gap of the interrupter during current interruption, the arc is diffused so as to minimize generated arcing products. U.S. Pat. No. 3,321,599 to T. H. Lee, assigned to the assignee of the present invention, is representative of art which uses a coil disposed external to the envelope of the interrupter to generate such a field. In pertinent part, Lee shows a coil disposed circumferentially about the vacuum envelope of an interrupter and extending substantially the length of the envelope. The coil is connected with a first of the interrupter contacts so as to be in series with the interrupter and hence the gap established therein when current is interrupted. Upon separation of the contacts to interrupt a current, the coil establishes an axial magnetic field in the gap. This axial magnetic field diffuses the arc so as to reduce arcing products and to permit the interruption of a substantially higher current than is possible in prior art interrupters.

Typical vacuum interrupter envelopes, such as the envelope shown in Lee, include a pair of electrically conductive end plates spaced by a cylindrical, electrically insulating wall. Each of these end plates is at the electrical potential of a respective one of the interrupter contacts, and the possibility of a potential breakdown or "strikeover" exists between the end plates through the relatively low-dielectric atmosphere outside the envelope. A coil of the type shown in Lee, being connected to a first of the contacts, is thus at the common potential of that contact and the end plate associated with that contact. The present inventors have discovered that when a coil is disposed outside of the envelope and for substantially the length of the envelope as in Lee, an undesirable possibility exists for a potential breakdown between that coil and the second end plate. Because the coil is at the potential of the first end plate and disposed in close proximity with the second end plate, the strikeover distance between the end plates is decreased to the distance between the closest point between the coil and the second end plate. The coil must thus be heavily insulated to prevent this electrical breakdown. This insulation increases both the complexity and the cost of the interrupter.

It would thus be desirable to provide a vacuum interrupter including a coil disposed so as to develop an axial magnetic field for diffusing an arc, but which does not substantially decrease the strikeover distance between the end plates. Such a vacuum interrupter would be capable of interrupting a high peak current without the additional complexity and cost of a highly insulated, lengthy coil. It would be further desirable if a method could be provided for modifying existing vacuum interrupters to provide the advantages of the present invention.

OBJECTS OF THE INVENTION

A principal object of the present invention is to provide a new and improved vacuum interrupter which is capable of interrupting a high peak current and which is simple and economical to manufacture.

Another object of the present invention is to provide a new and improved method for economically modifying a vacuum interrupter to increase the peak current interruption capacity thereof.

A more specific object of the present invention is to provide a new and improved vacuum interrupter including coils disposed so as to increase the peak current interruption capacity of the interrupter without increasing the likelihood of a current strikeover between a pair of end plates.

SUMMARY OF THE INVENTION

A new and improved vacuum interrupter includes a pair of coils disposed so as to increase the peak interruption current of the interrupter. Such a vacuum interrupter comprises an evacuated envelope and a pair of opposing contacts situated therein. These contacts are relatively movable along a common axis from an engaged position for conducting a current to a disengaged position for establishing an arc whereby to interrupt the current. A pair of electrical conductors are provided for connecting each of the contacts to a separate external electrical circuit, each of the conductors extending through the envelope along the common axis and into electrical connection with a respective one of the contacts. The coils are disposed outside of the envelope, on opposite sides of the contacts and generally coaxially therewith. Each coil is connected in series with a respective one of the contacts for establishing a generally axial magnetic field in the space between the contacts when the contacts are in the disengaged position. In operation, these coils are selected to provide a magnetic field of sufficient magnitude to maintain the arc in a diffuse condition, thereby minimizing arcing products and increasing the peak current interruption capacity of the interrupter. The coils are spaced a distance sufficient to prevent dielectrical breakdown therebetween before a predetermined electrical potential is established between the contacts.

The invention taught herein can be implemented on existing vacuum interrupters by modifying the same to include the magnetic field coils. Such modified vacuum interrupters provide the benefits and advantages of the invention described herein.

BRIEF DESCRIPTION OF THE DRAWINGS

While the specification concludes with claims defining the features of the invention that are regarded as novel, it is believed that the invention, together with further objects thereof, will be better understood from a consideration of the following description in conjunction with the drawing Figures, in which:

DESCRIPTION OF THE INVENTION

Figure 1:
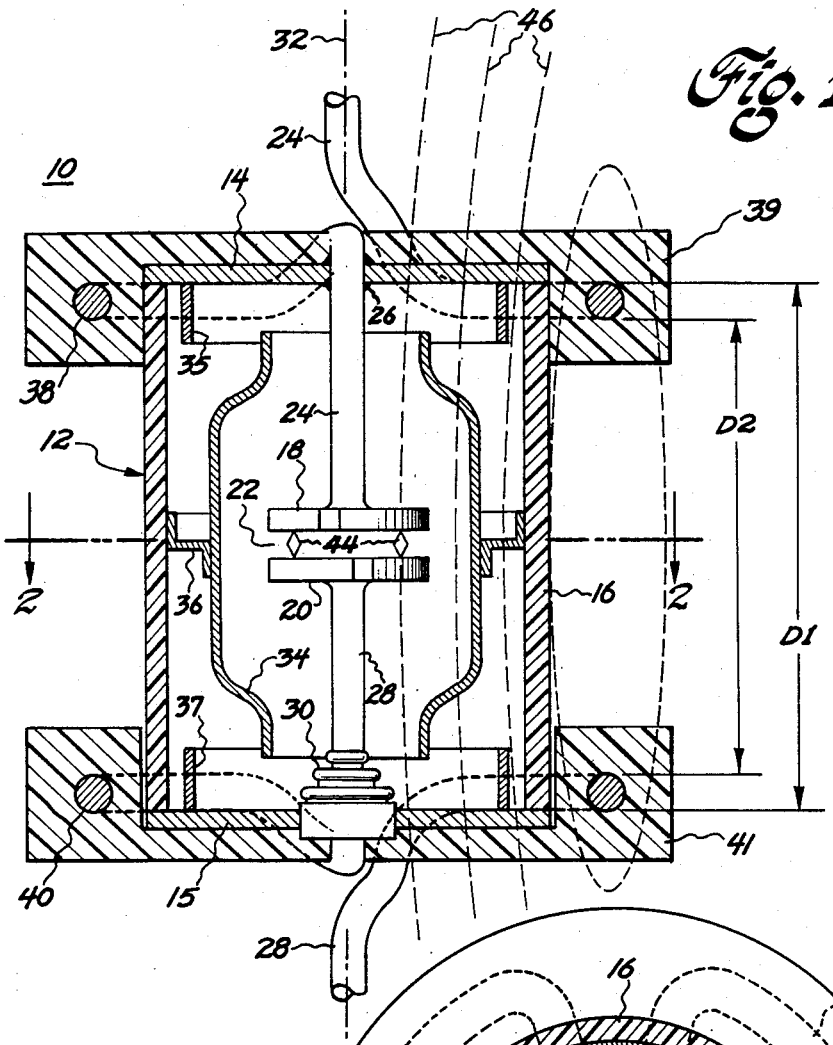
FIG. 1 illustrates a cross-sectional side view of a vacuum interrupter constructed in accordance with a first embodiment of the invention.
Figure 2:
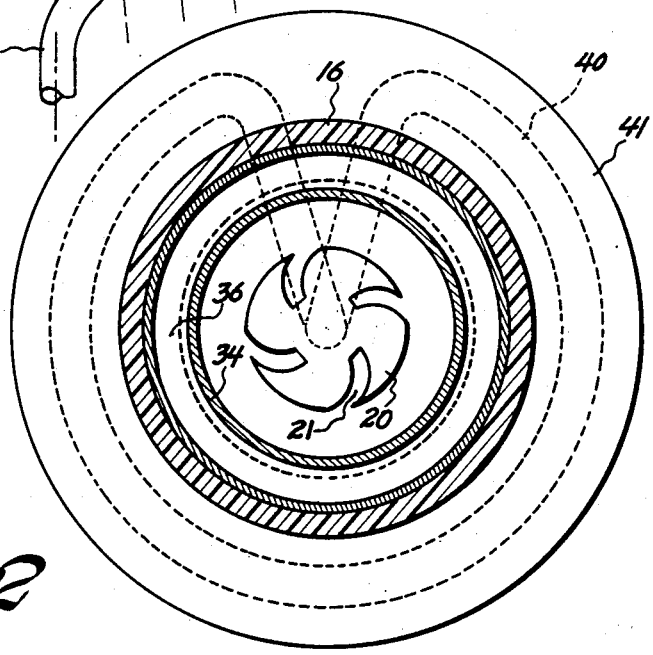
FIG. 2 illustrates a sectional view taken along line 2—2 of FIG. 1.

Referring now to FIGS. 1 and 2, a vacuum interrupter 10 includes a highly evacuated, generally cylindrical envelope 12 comprising a pair of electrically conducting metal end caps 14, 15 interconnected by an electrically insulating glass sidewall 16. End caps 14 and 15 are separated by a "strikeover" distance D1. As will be appreciated by those skilled in the art, the normal pressure in envelope 12 under static conditions is selected to be lower than $10^{-4}$ mm. of mercury, thereby providing reasonable assurance that the mean free path for electrons is longer than the potential breakdown paths in the envelope.

Situated within envelope 12 is a pair of relatively movable, opposing, and generally disc-shaped contacts 18 and 20 shown in their open or separated position with an arcing gap 22 disposed therebetween. Upper contact 18 is a stationary contact connected to a conductive rod 24, the rod being fastened to end cap 14 via a suitable seal such as a weld 26. Lower contact 20 is relatively movable with respect to contact 18, and is connected to a conductive operating rod 28 which extends through end cap 15 via a flexible bellows 30. Bellows 30 comprises for example steel, and is sealed both to rod 28 and end cap 15 for maintaining the vacuum in the envelope. Contacts 18, 20, envelope 12, and rods 24, 28 are generally coaxially disposed about a common axis 32, with the lower end of rod 28 (as viewed in FIG. 1) being suitably connected to an actuator (not shown) for controlling the motion of rod 28 and contact 20 along the axis.

Though the invention is not limited to any particular contact configuration, each contact 18, 20 is preferably constructed having arcuate radial slots 21 for distributing arc energy in a manner well known in to those skilled in the art. A discussion of such contacts suitable for use in vacuum interrupter 10 is found in U.S. Pat. No. 2,949,520 to Schneider. Schneider is assigned to the assignee of the present application, and the Schneider and above-mentioned Lee patents are both incorporated herein by reference.

Vacuum interrupter 10 further includes a generally cylindrical, metallic shield 34 disposed inside envelope 12 and surrounding contacts 18 and 20. Shield 34 is supported in envelope 12 by a metallic fastener 36 disposed between the outside of the shield and the inner surface of the envelope. A further pair of cylindrical metal shields 35, 37 are disposed inside of envelope 12 on end plates 14 and 15, respectively. Each metal shield 35, 37 extends from its respective end plate towards the center of envelope 12 and overlaps the adjacent ends of shield 34.

In accordance with the invention, a pair of generally circular coils 38 and 40 are disposed outside of envelope 12 substantially coaxially about axis 32, and on opposite sides of contacts 18, 20. In this embodiment of the invention, each coil 18, 20 comprises a single winding of heavy electrical conductor, for example 0.5 inch diameter copper conductor. Coil 38 is disposed proximate end plate 14 while coil 40 is disposed proximate end plate 15, the two coils being separated by a distance D2. Each coil 38, 40 is preferably set in an epoxy holder 39 and 41, respectively. Coil 38 is connected in electrical series with contact 18 via rod 24, while coil 40 is connected in electrical series with contact 20 via rod 28.

In operation, rods 26 and 28 provide for connection of contacts 18, 20 and hence vacuum interrupter 10 to an external circuit (not shown). Contacts 18 and 20 are normally in a closed, touching position (not shown) for conducting a current therethrough. In response to an external stimulus, for example a current overload in the external circuit, rod 28 is translated along axis 32 to move contact 20 into the open position illustrated in FIG. 1. When contacts 18 and 20 are first separated and the current being conducted therethrough has not yet reached a zero-crossing, an arc 44 is drawn across gap 22.

Simultaneously with the separation of contacts 18, 20, electromagnetic coils 38 and 40 operate to establish a magnetic field through vacuum interrupter 10, this magnetic field being indicated by field lines 46. As is shown by field lines 46, the magnetic field generated by coils 38 and 40 has a predominantly axial (i.e., with respect to contacts 18, 20 and axis 32) component in gap 22 between contacts 18 and 20. Coils 38, 40 are selected to generate a magnetic field of sufficient magnitude to maintain arc 44 in a diffuse distribution between contacts 18 and 20 and hence to minimize the formation of arcing products (not shown). The distance D2 between coils 38 and 40 is selected to maintain a sufficient dielectric strength so as to prevent a voltage breakdown or strikeover therebetween until a predetermined potential is established between contacts 18 and 20.

It will be appreciated by those skilled in the art that the ultimate strikeover distance on the outside of envelope 12 is the distance D1 between end caps 14 and 15. Thus, in high current applications above 10,000 amps, each coil 38, 40 is preferably situated proximate a respective end plate 14, 15 such that D1 approximately equals D2. However, it will be further appreciated that the distance D2 may be lessened depending on applicational requirements and desired operational characteristics. Each coil 38, 40 is maintained, however, on an opposite side of the contacts (i.e. coil 38 above contact 18 and coil 40 below contact 20 as viewed in FIG. 1). Metal shields 34 and 37 function in a manner well known to those skilled in the art to intercept and condense the vaporized metallic arcing products described hereinabove before they reach insulating envelope 12.

Figure 3:
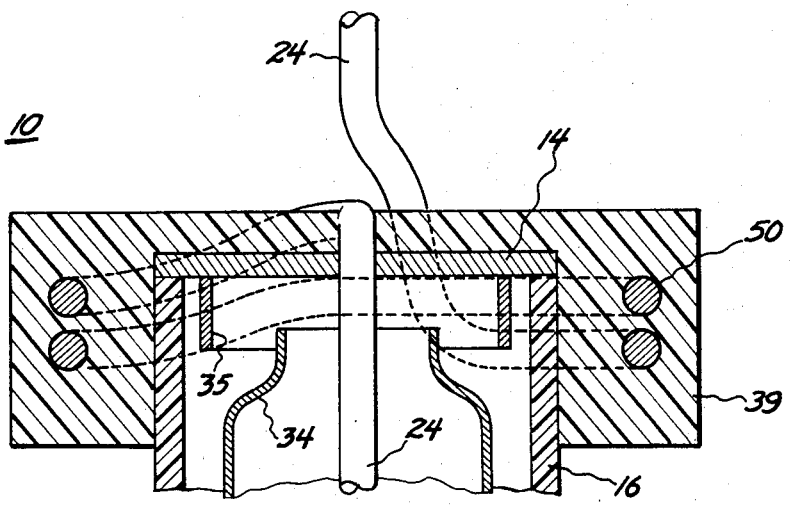
FIGS. 3 and 4 illustrate partial, cross-sectional side views of vacuum interrupters constructed in accordance with alternate embodiments of the invention.
Figure 4:
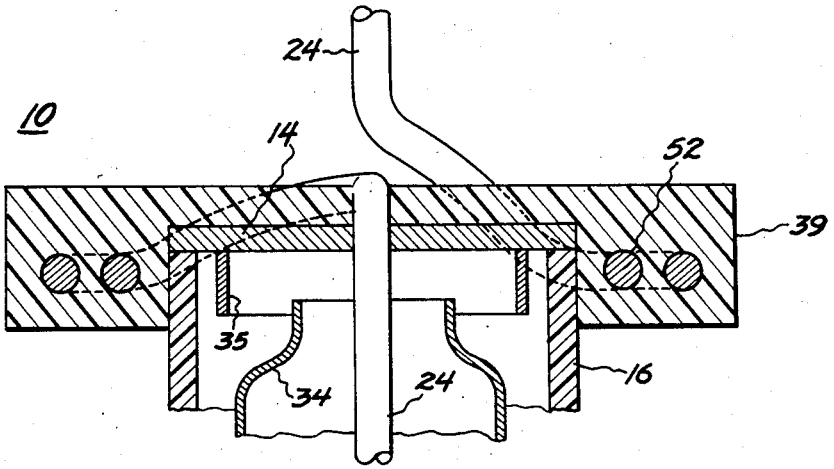

FIGS. 3 and 4 show alternate embodiments of vacuum interrupter 10 which are identical in structure to those of FIGS. 1 and 2 with the exception of the construction of the coils. For ease of understanding, identical features are indicated by like reference numerals.

In FIG. 3, coil 50 comprises two vertically juxtaposed windings. In FIG. 4, coil 52 comprises two horizontally aligned windings. It will be appreciated by those skilled in the art that the exact structure and configuration of the windings is selected dependent on the desired strength of the magnetic field in gap 22, the value of the field in gauss being a function of the coil inductance and distance from the gap.

The invention taught herein can be beneficially used in a method of modifying existing vacuum interrupters to increase their peak current interruption capacity. Such a method is performed by first providing a vacuum interrupter of the type shown in FIGS. 1–4 hereinabove, i.e. a vacuum interrupter including a pair of facing contacts situated within an evacuated envelope and relatively movable along a first axis from an engaged position for conducting a current to a disengaged position for establishing an arc whereby to interrupt the current. Two magnetic field coils of the type described hereinabove are provided, and these coils are disposed outside of the vacuum envelope, on generally opposite sides of and coaxially with the contacts. To complete the modification, each of these coils is connected in series with a respective one of the contacts such that the coils generate an axial magnetic field in the space between the contacts when the contacts are in the disengaged position.

An existing vacuum interrupter modified according to the above described method would exhibit the advantages described hereinabove. The method has particular advantage in that it can be straightforwardly and economically implemented on existing vacuum interrupters using conventional technologies.

The invention taught herein was tested by modifying a standard, 44,000 amp vacuum interrupter, according to the method of the present invention, to include a pair of magnetic field coils disposed in the manner shown and described hereinabove. These coils were selected to exert an axial magnetic field of approximately 400 gauss in the space between the open contacts. The thusly modified vacuum interrupter was subsequently measured as being capable of reliably interrupting 65,000 amps without strikeover between the coils. Hence, the capability of the vacuum interrupter was increased approximately 50%, a substantial improvement relative to the cost and effort needed to make the modification. It will be understood that this data comprises representative test data, and is not intended to limit the scope of the invention in any way.

There are thus provided multiple embodiments of improved vacuum type circuit interrupters, and a method of modifying existing vacuum interrupters to provide the same. Thusly constructed or modified vacuum interrupters provide the subsequent, very desirable advantage of an increased peak interruption current afforded by the axial magnetic field established via the coils, with a substantially decreased possibility of strikeover in comparison to prior art vacuum interrupters. Further, the method taught can be economically and straightforwardly implemented on existing vacuum interrupters using conventional technologies.

While preferred embodiments of the invention have been illustrated and described, it will be clear that the invention is not so limited. Numerous modifications, changes, variations, substitutions and equivalents will occur to those skilled in the art without departing from the spirit and scope of the present invention. For example, while movable contact 20 has been shown connected to a coil 40 and holder 41 that move therewith, it will be appreciated that a flexible or sliding connection could be used between the contact and coil such that the coil could be maintained stationary while the contact is moved. Accordingly, it is intended that the invention herein be limited only by the scope of the appended claims.

What is claimed is:

1. A vacuum interrupter comprising:

an evacuated envelope;

a pair of opposing contacts situated within said envelope and relatively movable from an engaged position for conducting a current to a disengaged position for establishing an arc whereby to interrupt said current;

a pair of electrical conductors, each of said electrical conductors extending through said envelope along said common axis and into electrical connection with a respective one of said contacts; and a pair of coils disposed outside of said envelope on opposite sides of said contacts and generally coaxially with said contacts, each of said coils connected in electrical series with a respective one of said electrical conductors so that an axial magnetic field is established in the space between said contacts when said contacts are in said disengaged position.

2. The vacuum interrupter of claim 1 wherein said coils are selected to establish said magnetic field of a sufficient magnitude to maintain said arc in a diffuse condition.

3. The vacuum interrupter of claim 1 wherein said coils are spaced a distance sufficient to prevent electrical arcing therebetween before a predetermined electrical potential is established between said contacts.

4. The vacuum interrupter of claim 1 wherein:

said evacuated envelope includes a pair of generally parallel electrically conductive end plates spaced by an electrically insulating sidewall; and each of said electrical conductors extends into said evacuated envelope along said common axis through a respective one of said end plates.

5. The vacuum interrupter of claim 4 wherein said envelope comprises a hollow cylinder disposed coaxially with said contacts, each of said end plates comprising an end of said cylinder.

6. The vacuum interrupter of claim 5 wherein each of said coils is disposed proximate a respective one of said end plates so that said coils are spaced approximately the length of said cylinder sidewall.

7. The vacuum interrupter of claim 5 wherein each of said coils is encapsulated in an electrically insulating matrix.

8. The vacuum interrupter of claim 5 wherein each of said contacts is generally disc shaped and includes slots disposed therein for distributing said arc.

9. A vacuum interrupter comprising:

a generally cylindrical evacuated envelope comprising a pair of electrically conducting end caps spaced by an electrically insulating sidewall;

a pair of generally circular opposing contacts situated within said envelope, said contacts generally coaxial with said envelope about a common axis, said contacts relatively movable along said common axis from an engaged position for conducting a current to a disengaged position for establishing an arc whereby to interrupt said current;

a pair of electrical conductors, each of said electrical conductors extending through a respective one of said end caps into said envelope along said common axis and into electrical connection with a respective one of said contacts; and a pair of coils disposed outside of said envelope and generally coaxially therewith, each of said coils comprising at least one turn of wire connected in electrical series with a respective one of said electrical conductors, and each of said coils disposed proximate a respective one of said end caps so that said pair of coils are spaced by approximately the length of said sidewall.

10. A method of modifying a vacuum interrupter of the type wherein a pair of facing contacts are situated within an evacuated envelope and relatively movable along an axis from an engaged position for conducting a current to a disengaged position for establishing an arc whereby to interrupt said current, and wherein a pair of electrical conductors extend through said envelope, each of said electrical conductors making electrical connection with a respective one of said contacts, said method comprising the steps of:

providing first and second coils;

disposing said coils outside of said envelope on opposite sides of said contacts and generally coaxially with said contacts;

connecting each of said coils in series with a respective one of said conductors such that said coils generate an axial magnetic field in the space between said contacts when said contacts are in said disengaged position.

11. The method of claim 10 wherein said providing step comprises providing coils selected to establish said axial magnetic field of sufficient magnitude to maintain said arc in a diffuse condition.

12. The method of claim 10 wherein said step of disposing comprises disposing said coils spaced a distance sufficient to prevent electrical arcing therebetween before a predetermined electrical potential is established between said contacts.

13. The method of claim 10 wherein said envelope comprises a hollow cylinder including a pair of electrically conductive end caps spaced by an electrically insulating sidewall and wherein said disposing step comprises disposing each of said coils proximate a respective one of said end caps.

14. The method of claim 13 and further including the step of encapsulating each of said end caps in an electrically insulating matrix.

* * * * *